United States Patent [19]

Nelson et al.

[11] Patent Number: 4,962,290

[45] Date of Patent: Oct. 9, 1990

[54] SHAFT POSITION INDICATING AND DISPLAY MEANS WITH ADJUSTABLE MOUNTING ADAPTER

[75] Inventors: Gerald J. Nelson; Wally Stommes, both of Fergus Falls; John Rose, Underwood, all of Minn.

[73] Assignee: Stonel Corporation, Fergus Falls, Minn.

[21] Appl. No.: 434,368

[22] Filed: Nov. 13, 1989

[51] Int. Cl.[5] ..... H01H 3/32; H01H 19/60; H01H 9/16

[52] U.S. Cl. ..... 200/308; 200/336; 200/309; 200/296; 200/574; 200/568

[58] Field of Search ..... 200/31 R, 564, 567, 200/568, 573, 574, 296, 293, 294, 302.1, 308, 309, 336

[56] References Cited

U.S. PATENT DOCUMENTS

| | | | |
|---|---|---|---|
| 3,446,924 | 5/1969 | Giambertoni | 200/308 X |
| 3,754,106 | 8/1973 | MacDonald | 200/308 X |
| 3,781,499 | 12/1973 | Reichert et al. | 200/336 X |
| 3,903,383 | 9/1975 | Marker | 200/308 X |
| 4,107,500 | 8/1978 | Distler et al. | 200/308 |
| 4,214,133 | 7/1980 | Wolford et al. | 200/31 R |
| 4,288,671 | 9/1981 | Morrison | 200/308 X |

*Primary Examiner*—Ernest G. Cusick

*Attorney, Agent, or Firm*—Haugen and Nikolai, P.A.

[57] ABSTRACT

A mechanism for providing electrical or pneumatic signals indicative of the rotation position of a rotatable shaft includes a switch housing mounted on a base with a cam shaft passing upward through the base and supporting one or more cam elements for cooperating with electrical switches contained within the housing. The base is especially designed to support a flared drum on the outer surface of which are graphic characters viewable through a window on a fixed indicator cover and visible from above and the sides for visibly displaying the orientation of the rotary shaft. The mounting mechanism including a system of brackets and spacers permits the device to be used with a variety of devices incorporating a rotatable shaft.

8 Claims, 2 Drawing Sheets

20
10
70
74
62
46
52
40
18
48
58
68
66
16
54
12
14
72

22

20
24
32
10
34
32
29
27
34
70
74
18
28
44
30
26
23
46
25
50
54
38
48
56
56
36
72
40
66
60
58
14

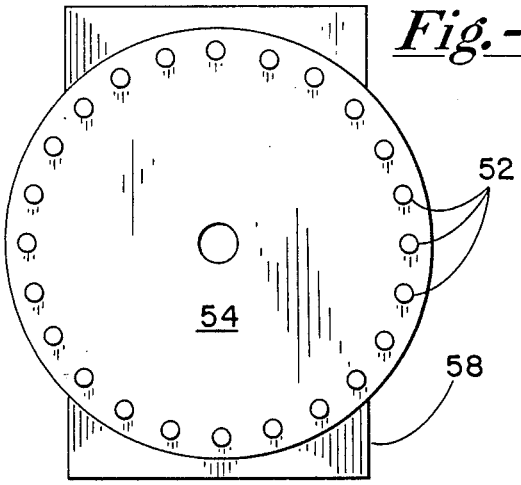
Fig.-3
Fig.-4
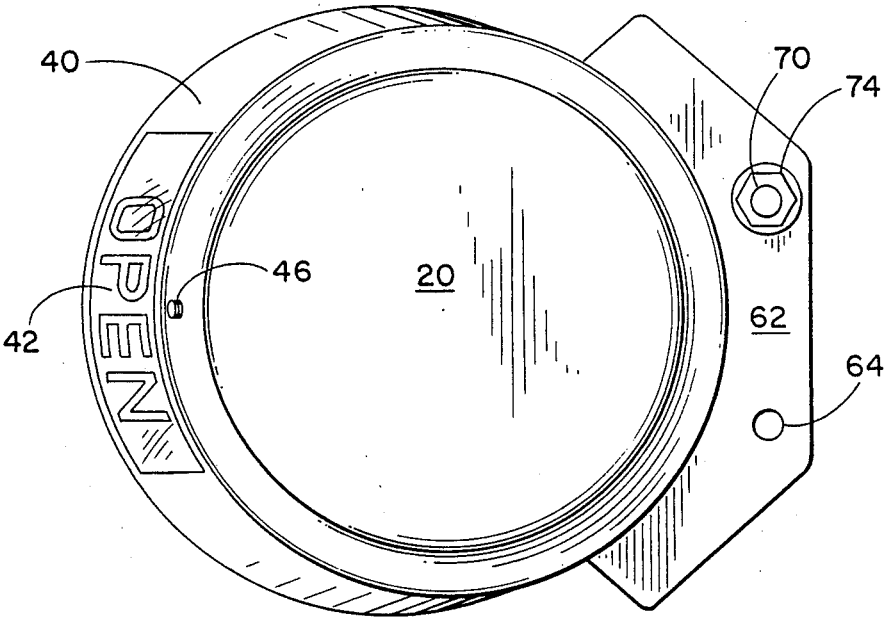

SHAFT POSITION INDICATING AND DISPLAY MEANS WITH ADJUSTABLE MOUNTING ADAPTER

BACKGROUND OF THE INVENTION

I. Field of the Invention

The present invention relates generally to apparatus for providing signals indicative of the rotation position of a rotary shaft, such as the shaft on a flow control valve, and more particularly to an improved rotary shaft position indicating mechanism incorporating a visual display of the shaft position and an improved mounting arrangement affording greater flexibility in adapting the rotary shaft position indicating and display assembly in conjunction with other telemetry and control apparatus to a variety of devices in the field.

II. Discussion of the Prior Art

In the Wolford et al U.S. Pat. No. 4,214,133 there is disclosed a rotary shaft position switch used for telemetering the positioning of a rotatable shaft, such as on a flow control valve to a remote location for indicating whether that valve is opened or closed. The device of the aforereferenced patent, however, did not provide any means for visually indicating to persons within view of the valve assembly whether it is opened or closed.

Accord, Inc. of Cincinnati, Ohio, manufactures and sells a rotary shaft position indicator in which a cam shaft passes through the base portion thereof and is journaled for rotation therein. The cam shaft supports one or more cams for cooperating with Microswitches with the shaft passing upward through the housing cover and into a plastic dome having an inner member secured to the cam shaft and containing printed graphics information and an outer member which is generally opaque except for a transparent window through which the graphics information can be read.

The Accord device, therefore, required extra sealing to make the switch housing weather and water tight. Moreover, if it becomes necessary to remove the switch housing cover for adjustment of the cams relative to the switches, the cam shaft must also be slipped out of the seal to the visual indicator in the dome, thus making it necessary to reorient the display graphics upon reassembly. In addition, the size and positioning of the window through which the graphics can be observed is only viewable when the observer is positioned in a limited zone.

Another company, Proximity Controls, Inc., of Fergus Falls, Minn., manufactures and sells a line of valve position indicators also including a visual display capability. In the Proximity Controls, Inc.'s devices, the visual indicator is mounted to the switch enclosure at a location between the valve being monitored and the switches. The indicator in question is made of two plastic drums, one inside the other, where the inner drum includes words, symbols or other graphics which may be viewed through a window formed in the outer drum. While that arrangement is deemed to be an improvement over the Accord arrangement in that it does not require that the cam shaft pass through the switch housing cover into a display dome, it suffers from the drawback that the visual indicator is physically located beneath the switch housing such that it cannot be seen from above. Moreover, the window opening is relatively small in size, making the graphics information difficult to see from any appreciable distance.

The designs of the Accord and Proximity Controls rotary shaft position indicators have additional drawbacks, especially as it relates to adapting the devices to an existing valve or other mechanism with which it is to be used in the field. Specifically, when mounting the Proximity Controls device to an existing valve shaft, the screw holding the coupling yoke and the inner drum to the cam shaft must be loosened to set the inner drum to correspond to the window in the outer drum when the valve is in the OPEN or CLOSED position. Following that, the switch housing is then mounted. If the two drums do not correspond exactly, the switch housing must be removed, the yoke screw loosened to adjust the inner drum, then remounted. This may require several repetitions until proper alignment is achieved. When it becomes necessary to adjust the outer drum so as to move the window to a more visible location, it again becomes necessary to remove the housing to reposition the outer drum. Typically, new screw holes must be formed and following that, the unit must be reassembled with the inner drum being adjusted with the yoke attaching screw to again cause the graphics image to be viewable through the window of the outer drum when the rotary shaft is in the appropriate position indicated by the word visible through the window.

Still another problem with the prior art rotary shaft position indicators relates to the difficulty in adapting the indicator to the variety of valve types found in the field with which the indicators are to be used. Since there is no standard dimensions in terms of valve shaft length and lateral displacement of the mounting pad relative to the valve shaft location, suppliers of rotary shaft position indicators are forced to provide a wide variety of mountings to accommodate different manufacturers, size of valve and actuators as well as combinations of actuators and position indicators. Because of the hundreds of different valves and actuators to fit, attempts have been made by others to fabricate a universal bracket allowing a given model of shaft position indicator to fit many different valves and valve actuators but without much success.

OBJECTS

It is accordingly a principal object of the present invention to provide an improved rotary shaft position indicating and display apparatus.

Another object of the invention is to provide a rotary shaft position indicator and display that is easy to install in the field.

Yet another object of the invention is to provide a rotary shaft indicator with electrical telemetry and display device where the display device can be readily adjusted in the field to allow adaptation to a wide variety of devices embodying shafts whose position is to be monitored.

A yet further object of the invention is to provide a rotary shaft indicator and display switch mechanism having a display element which is viewable from above as well as from the side.

A yet further object of the invention is to provide a mounting mechanism which is universally adaptable to a wide variety of machines whose shaft positions are to be monitored.

SUMMARY OF THE INVENTION

The foregoing features and objects are achieved in accordance with the present invention by providing a rotary shaft position indicating and display apparatus for use with devices having a rotatable shaft in which the apparatus includes a housing having a base and a cover secured to the base so as to define a hollow, sealed chamber. An actuator shaft, e.g., a cam shaft, extends through the base into the sealed chamber and is journaled for rotation in that base. At least one electromechanical activating element is mounted on the actuator shaft for cooperation with corresponding signal generating element, e.g., mounted on the base and within the sealed chamber. Alternatively, actuator shaft may be coupled to a potentiometer used to develop the signal. To display the state of the valve or other device with which the rotary shaft position indicating and display apparatus is used, a frusto-conical member is secured to the under side of the base and that member is downwardly and outwardly flared. It is preferably formed from a transparent plastic which is rendered opaque except for two oppositely disposed windows. A second frusto-conical member is concentrically disposed within the confines of the first frusto-conical member and includes graphics information thereon viewable through the window areas.

A spacer of a predetermined height dimension is coupled to the cam shaft and to the inner frusto-conical member for rotating that inner member along with the actuator shaft. A U-shaped yoke is secured to the exposed surface of the spacer and is used for coupling the actuator shaft to the rotary shaft to be monitored.

The spacer and inner drum are designed such that the inner drum can be indexed at predetermined discrete angular positions before being fixedly coupled to the actuator shaft, thus allowing ready adjustment of the graphics on the drum relative to the rotary shaft with which the device is used. Moreover, the outer frusto-conical drum may be rotated so as to position the window at a desired angular location and then secured in place, negating the need to disassemble the entire rotary shaft indicating and display mechanism in order to achieve proper alignment.

To facilitate mounting the assembly of the present invention, the base includes a mounting flange integrally formed therewith where the mounting flange includes a pair of spaced-apart through-holes passing through the base and generally parallel to the device's actuator shaft. Additional spacers having a height dimension equal to the height dimension of the spacer used to join the drum to the actuator shaft are insertable between the mounting flange on the base and a mounting bracket affixed to the device whose shaft is to be monitored. These spacers also include through-holes which when aligned with those in the mounting flange allow bolts to be inserted upward through the aligned holes. The associated nuts then may be screwed down onto the mounting flange from an easily accessible point to hold the rotary shaft indicator mechanism in place. Because of the manner in which the spacers are dimensioned, a variety of vertical offsets between the rotatable shaft of the device in the field and the mounting bracket can be accommodated.

DESCRIPTION OF THE DRAWINGS

The foregoing objects and features of the invention will become apparent to those skilled in the art from the following detailed description of a preferred embodiment, especially when considered in conjunction with the accompanying drawings in which like numerals in the several views refer to corresponding parts.

FIG. 3 is a bottom view of the yoke and spacer; and

FIG. 4 is a top view of the device of FIG. 2.

DESCRIPTION OF THE PREFERRED EMBODIMENT

Figure 1:
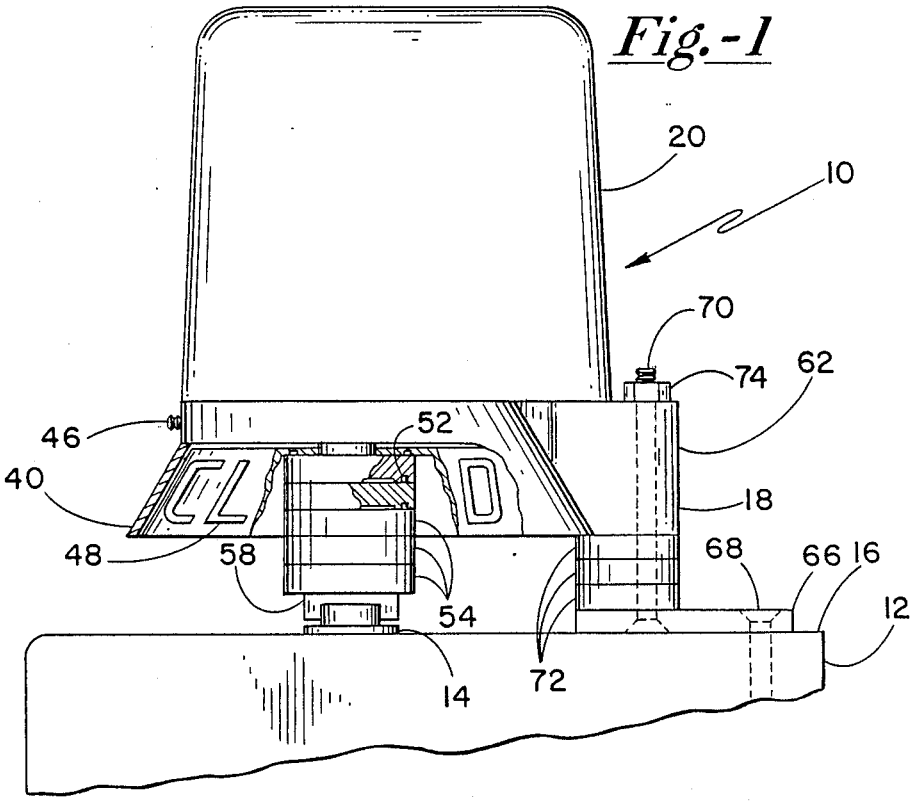
FIG. 1 is a partial side elevation showing the manner in which the rotatable shaft indicator and display device of the present invention is attached to a valve or valve actuator.

Referring first to FIG. 1, there is indicated generally by numeral 10 a rotary shaft position indicating switch assembly mounted on a valve or a hydraulic or pneumatic valve actuator 12 having a rotary shaft 14 projecting therefrom whose position is to be telemetered to a remote location. The valve actuator 12 while generally cylindrical or irregular in shape is provided with a planar mounting surface indicated by the numeral 16.

Figure 2:
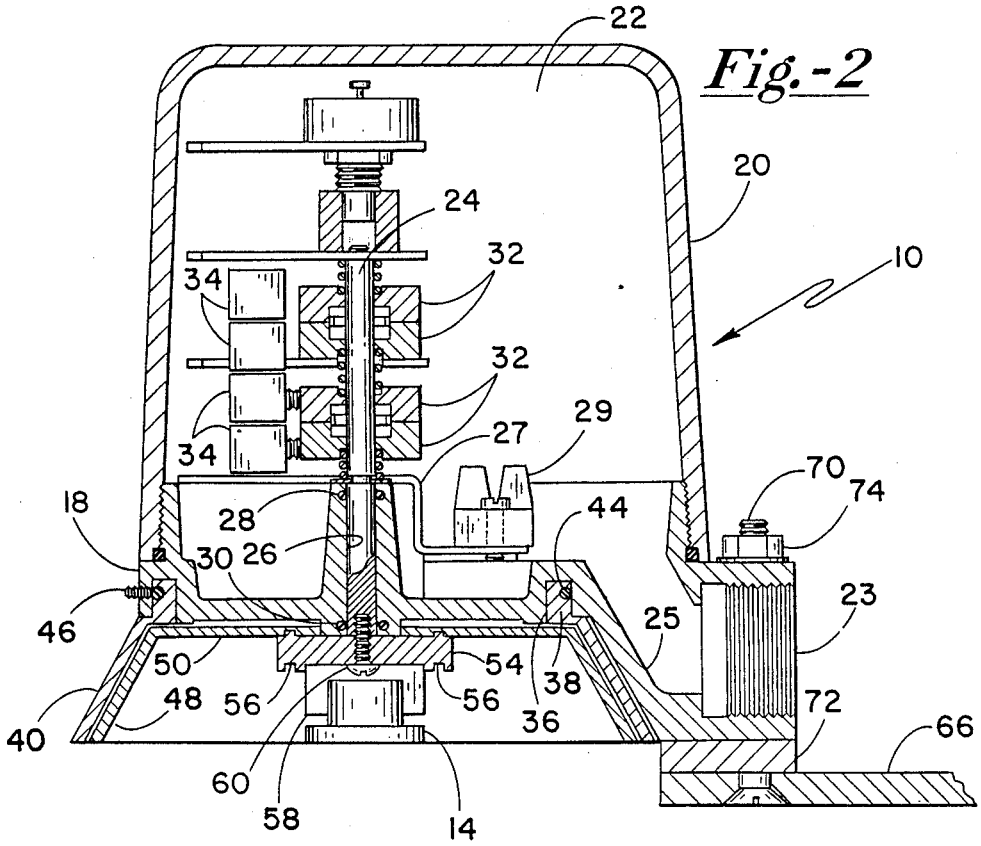
FIG. 2 is a side cross-sectional view of the rotary shaft indicator and display mechanism in accordance with this invention.

The rotary shaft position indicating and display assembly 10 is seen to include a housing including base member 18, which may be molded from a suitable metal or plastic material, and a cover 20 affixed thereto. The base 18 and cover 20 define a hollow sealed chamber 22 (FIG. 2). The base includes a threaded opening 23 for receiving a fitting (not shown) on the end of electric conduit in which wiring for the switch assembly 10 passes. The base further includes a ramp surface 25 forward of the opening 23 which serves to feed the wires up toward a terminal strip 29 when the ends are pushed through the opening 23.

As is further shown in FIG. 2, an actuator shaft member 24 is journaled for rotation in a bore 26 formed in the base member 18. The actuator shaft 24 projects upwardly through a bottom plate member 27 into the interior of the chamber 22 and O-rings as at 28 and 30 provide a shaft seal preventing the ingress of dust or moisture into the chamber.

Secured to the actuator shaft along its length are one or more electromechanical actuating elements which are designed to cooperate with a mating device for producing an electrical signal. For example, the actuator elements may be cam, as at 32, which are adapted to engage the actuator arm (not shown) of corresponding proximity and snap action switches 34 mounted in stacked relation on the bottom plate 27 within the sealed chamber 22. The cams are positioned such that as the actuator shaft 24 rotates, different ones of the switches 34 will be actuated at different points in the rotational travel of that shaft, all as is well known in the art relating to rotary shaft position indicating devices of the type involved here.

In the embodiment of the present invention, an annular groove 36 is formed in the undersurface of the base member 18, that groove being concentric with the actuator shaft 24. The annular groove 36 receives an annular cylindrical projection 38 formed integrally with an outer drum or cover 40. The drum 40 is frusto-conical in shape and, as such, is flared so as to project outwardly and downwardly relative to the base member 18. The drum 40 is preferably formed from a suitable plastic and is generally opaque, save for one or more window areas formed thereon which are transparent, as indicated by numeral 42 in FIG. 4. An O-ring 44 may be fitted into a groove formed in the cylindrical projection 38 to provide a seal between the frusto-conical member 40 and the base 18. Furthermore, the angular position of the windows of the drum 40 can be set relative to the base by first loosening the set screw 46, rotating the drum 40 clockwise or counterclockwise and then retightening the set screw.

Disposed immediately below the outer frusto-conical drum 40 is an inner drum 48 which also is frusto-conical in shape, having flared side walls and a generally planar top surface 50 integrally formed therewith. Provided on the outer surface of the flared portion of the drum 48 are words or other graphics, as can best be seen in FIG. 1. When these graphics are aligned with the window 42 of the outer drum 40, they become visible to a viewer. Thus, in the case of a valve, the words "OPEN" and "CLOSED" may be displayed to provide a person with an indication of the status of that particular valve at any given time.

Formed inwardly through the top surface 50 of the inner drum 48 are a series of circumferentially spaced holes which may, for example, be positioned at 15 degree intervals. These holes are intended to mate with a plurality of pins 52 projecting upwardly from a spacer member 54. The spacer member 54 is preferably molded from a suitable plastic and is of a predetermined thickness dimension. It also includes a plurality of apertures as at 56 formed in the undersurface thereof so that further identical spacer members can be stacked by aligning the pins 52 of one with the apertures 56 of the other.

Affixed to the undersurface of the bottommost one of the spacers 54 is a U-shaped yoke member 58. It is secured to the actuator shaft 24 by means of a screw-type fastener 60. The legs of the U-shaped yoke 58 are arranged to straddle flats formed on the valve shaft 14 so that when the shaft 14 rotates, the spacer(s) 56, the inner drum 48 and the actuator shaft 24 turn with it.

From the top view of FIG. 4, it can be seen that the molded or machined base member 18 includes a mounting flange 62 having a pair of through-holes 64 extending through the thickness dimension thereof. In mounting the rotary shaft position indicating and display assembly 10 on a valve or valve actuator 12, a bracket, as at 66, is first fastened by bolts 68 to the planar mounting surface 16 of the valve with screw-type fasteners, as at 70, extending through appropriately spaced holes formed in the mounting bracket 66. To accommodate a variety of offsets and height differentials between the planar mounting surface 16 and the shaft 14 which may be encountered in the field, a series of further spacers as at 72 can be stacked between the undersurface of the mounting flange portion 62 of the base 18 and the mounting bracket 66. Next, the rotary shaft position indicating switch assembly 10 is fitted over the bolts 70 and nuts as at 74 are turned onto the bolts to hold the assembly in place.

It is to be especially noted that the thickness dimension of the further spacer members 72 are the same as or increments of the thickness dimension of the spacers 54 associated with the actuator shaft 24 and it is possible to readily raise and lower the yoke 58 relative to the base 18 or the base 18 relative to the mounting surface 16 to adapt the rotary shaft position indicator to a wide range of offsets that may be encountered. In that the through-bolts 70 are initially inserted through the mounting bracket 66 from below and the nuts 74 are atop the mounting flange 62, they are readily accessible and can be easily tightened with a wrench.

Not only does the present invention allow ease in mounting the rotary shaft position and display assembly 10 in the field to a wide variety of devices having rotatable shafts, but it also permits ready adjustment of the graphics on the inner drum 48 relative to the windows on the outer drum 40. Before assembly to the bracket plate, the inner drum may be oriented in the appropriate position by merely loosening the screw 60 and disengaging the pins 52 from the holes formed in the drum surface 50 so that the yoke 58 may be rotated in 15 degree increments to a desired position relative to the flats on the shaft 14 when that shaft is in a predetermined reference position Then, when the screw is retightened, the yoke is in the appropriate orientation. Following complete assembly, any slight misregistration between the graphics and the windows can be accommodated by loosening the set screw 46 and slightly rotating the outer drum 40 to better align the window areas with the graphics.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. Rotary shaft position indicating and display means for use with a device having a rotatable shaft and a planar mounting surface, comprising:

(a) a housing having a base with a cover secured to said base and defining a hollow sealed chamber;

(b) an actuator shaft journaled for rotation in said base and extending through said base into said sealed chamber;

(c) at least one electromechanical actuating element mounted on said actuator shaft;

(d) means coupled to said base within said chamber for actuation by said at least one electromechanical actuating element;

(e) a first frusto-conical member secured to the under side of said base, said first member being downwardly and outwardly flared and being formed from at least in part of a transparent plastic material to define at least one window area;

(f) a second frusto-conical member concentrically disposed relative to said first frusto-conical member and including graphics information viewable through said at least one window area;

(g) first spacer means of a predetermined height dimension and having first and second side surfaces, the first side surface abutting and affixed to said actuator shaft and to said second frusto-conical member for rotating said second frusto-conical member with said actuator shaft; and (h) yoke means secured to the second side surface of said first spacer means for coupling said first spacer means to said rotatable shaft of said device.

2. The rotary shaft position indicating and display means as in claim 1 wherein said second frusto-conical member includes a plurality of recesses circumferentially spaced at regular angular intervals and concentrically disposed relative to said actuator shaft.

3. The rotary shaft position indicating and display means as in claim 2 wherein said first spacer means includes a plurality of pins projecting from said first surface thereof for insertion into said plurality of recesses in said second frusto-conical member.

4. The rotary shaft position indicating and display means as in claim 1 wherein said first frusto-conical member includes an upwardly projecting annular ring integrally formed therewith and said base includes an annular groove for receiving said annular ring.

5. The rotary shaft position indicating and display means as in claim 4 and further including means for releasibly locking said annular ring in said annular groove.

6. The rotary shaft position indicating and display means as in claim 1 wherein said base further includes:

(a) a mounting flange integrally formed therewith, said mounting flange including a pair of spaced-apart through-holes extending therethrough parallel to said actuator shaft and radially offset therefrom;

(b) a mounting bracket adapted for attachment to said planar mounting surface of said device; and (c) further spacer means having a height dimension equal to said predetermined height dimension of said first spacer means and a pair of spaced-apart through-holes, said further spacer means being insertable between said mounting flange on said base and said mounting bracket with the through-holes of said further spacer means being aligned with said through-holes on said mounting flange.

7. The rotary shaft position indicating and display means as in claim 6 and further including fastening means insertable through said mounting bracket, said through-holes in said further spacer means and said through-holes of said mounting flange when aligned.

8. The rotary shaft position indicating and display means as in claim 6 wherein a plurality of said first spacer means and a plurality of said further spacer means are stackable relative to one another.

* * * * *